US006308862B1

(12) United States Patent
Fillmore et al.

(10) Patent No.: US 6,308,862 B1
(45) **Date of Patent: *Oct. 30, 2001**

(54) DISPENSER PACKAGE FOR DUAL VISCOUS PRODUCTS

(75) Inventors: William E. Fillmore, Toledo; Raj Krishna, Sylvania, both of OH (US)

(73) Assignee: Owens-Illinois Closure Inc., Toledo, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 07/874,487

(22) Filed: Apr. 27, 1992

Related U.S. Application Data

(63) Continuation-in-part of application No. 07/759,328, filed on Sep. 13, 1991.

(51) Int. Cl.[7] ..... B65D 35/22; B65D 35/14

(52) U.S. Cl. ..... 222/94; 222/95; 222/105; 222/145.3; 222/215

(58) Field of Search ..... 222/386.5, 94, 222/105, 95, 145, 206–213, 183, 215, 145.1–145.8

(56) References Cited

U.S. PATENT DOCUMENTS

| | | | | |
|---|---|---|---|---|
| 2,608,320 | | 8/1952 | Harrison . | |
| 2,743,038 | | 4/1956 | Ferries . | |
| 2,804,995 | | 9/1957 | Fee . | |
| 3,070,265 | * | 12/1962 | Everett | 222/389 X |
| 3,241,722 | * | 3/1966 | Nissen | 222/136 |
| 3,580,429 | * | 5/1971 | Trindle | 222/105 |
| 3,592,365 | | 7/1971 | Schwartzman . | |
| 3,620,420 | * | 11/1971 | Normos | 222/386.5 |
| 3,656,660 | * | 4/1972 | Mueller | 222/94 |
| 3,669,323 | | 6/1972 | Harker . | |
| 4,077,544 | * | 3/1978 | Malacheski et al. | 222/105 X |
| 4,089,443 | * | 5/1978 | Zrinyi | 222/386.5 |
| 4,098,434 | | 7/1978 | Uhlig . | |
| 4,469,250 | | 9/1984 | Evezich . | |
| 4,562,942 | * | 1/1986 | Diamond | 222/386.5 |
| 4,760,937 | | 8/1988 | Evezich . | |
| 4,838,457 | * | 6/1989 | Swahl et al. | 222/145 X |
| 4,842,165 | | 6/1989 | Van Coney . | |
| 4,909,416 | | 3/1990 | Evezich . | |
| 4,964,539 | * | 10/1990 | Mueller | 222/145 X |
| 5,012,956 | * | 5/1991 | Stoody | 222/94 |

FOREIGN PATENT DOCUMENTS

| | | | |
|---|---|---|---|
| 2081244 | * | 12/1971 | (FR) . |
| 2184491 | * | 6/1987 | (GB) . |

* cited by examiner

*Primary Examiner*—Kenneth Bomberg

(57) ABSTRACT

A dispenser package for dispensing dual viscous products which are separately retained within the package and merged at a dispensing nozzle. The dispensing package comprises a container having a compressible portion and a hanger and pouch assembly of plastic material suspended in the container. The hanger has an upper portion with a pair of openings. A flexible film pouch having an opening is bonded in each opening in the hanger and has portions bonded to the hanger. The hanger has lower portions comprising of spaced flexible walls associated with each pouch. The head assembly includes a one-way valve associated with each opening in the hanger and a portion which maintains the viscous products from each of the pouches separate until they pass from a nozzle on the head assembly to the exterior when the compressible portion of the container is squeezed. An atmospheric valve is provided for equalizing the pressure after the compressible portion of the container has been released and the hanger and pouch assembly returns to its original position.

31 Claims, 8 Drawing Sheets

FIG. 13
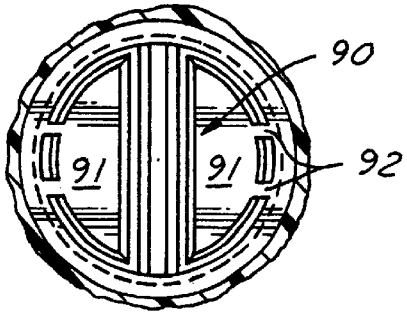
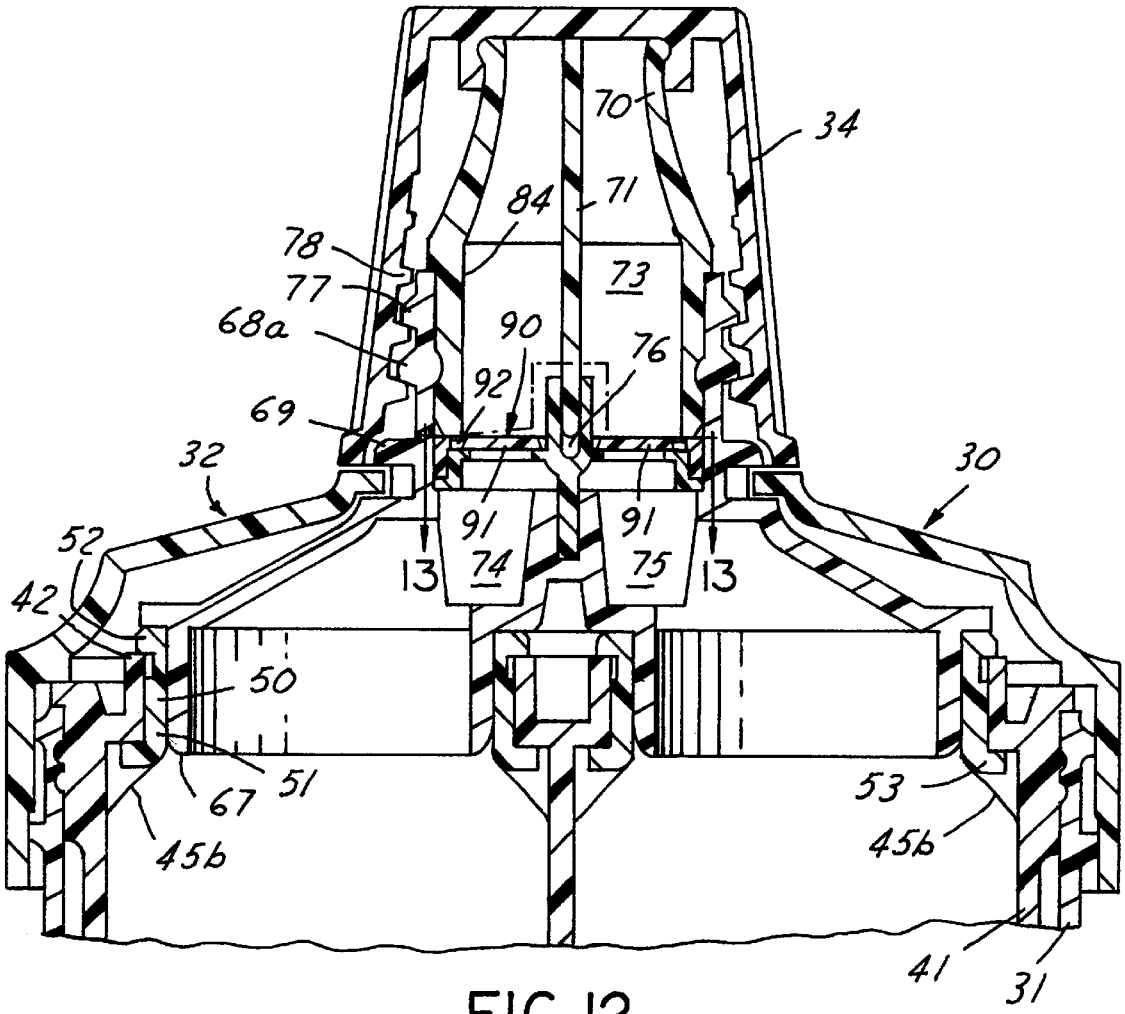
FIG. 12

DISPENSER PACKAGE FOR DUAL VISCOUS PRODUCTS

This application is a continuation-in-part application of U.S. application Ser. No. 07/759,328, filed Sep. 13. 1991.

This invention relates to squeeze dispensers for viscous products.

BACKGROUND AND SUMMARY OF THE INVENTION

It has heretofore been suggested that dispensers for viscous products comprise a container which contains the product and which is squeezed to dispense the product. In one type of such a dispenser, a bag or pouch containing the viscous product is provided within a container so that when the compressible sidewall of the container is squeezed, the product is dispensed through a opening or nozzle. In U.S. Pat. No. 2,608,320 issued Aug. 26, 1952 there is shown a dispenser which has a cartridge as a refill unit which contains the viscous product. The cartridge has a rigid upper portion and a flexible lower portion and is suspended in a container or holder and a removable cap is provided on the container. When the flexible portion of the container is squeezed, the viscous product is dispensed through an opening in a disk on the upper end of the cartridge and an opening in the cap. An atmospheric valve is provided on the lower end of the container which closes upon squeezing of the flexible portion of the container. Other similar dispensers are shown in U.S. Pat. No. 2,743,038 (1965) and U.S. Pat. No. 2,804,995 (1957) which have an opening that is covered by the finger of the user rather than an atmospheric valve. Dispensing closures with a valve in the dispensing portion have also been suggested in the prior art as shown in U.S. Pat. No. 3,592,365 (1971), and U.S. Pat. No. 3,669,223 (1972). Squeeze pump packages are shown in U.S. Pat. Nos. 4,842,165, 4,098,434, 4,469,250, 4,760,937 and 4,909,416.

In the aforementioned U.S. application Ser. No. 07/759, 328, filed Sep. 13, 1991, a squeeze dispenser package comprising a container having a compressible portion and a hanger and pouch assembly of plastic material, suspended in the container. The hanger has an upper portion having an opening and a flexible film pouch having an opening is bonded to the opening in the hanger and has portions thereof bonded to the hanger. The hanger has a lower flexible portion comprising spaced flexible walls. In one form, a removable head is mounted on the container and overlies the hanger and pouch assembly. The head includes a nozzle having an opening overlying the opening in the pouch and an atmospheric valve is provided for equalizing the pressure after the compressible portions of the container has been released and the hanger and pouch assembly returns to its original position. The squeeze dispenser package comprises a novel hanger and pouch assembly that can be filled from the top; wherein the pouch is fully preformed before filling; wherein the package can be refilled by replacing the hanger and pouch assembly; wherein the package can be readily manufactured in high production; and which efficiently dispenses the viscous product.

In another type of dispenser package, two viscous products are kept separately because of their chemical nature and are permitted to merge only after passing through a nozzle to the atmosphere. A typical such package comprises a viscous product such as a baking soda product and peroxide viscous product that upon merging provide an effective toothpaste.

Among the objectives of the present are to provide a dispenser package of the type shown in the aforementioned application Ser. No. 07/759,328 filed Sep. 13, 1991 which will effectively dispense two components which are not mixed until they pass into the atmosphere.

In accordance with the invention, the dispenser package provides for dispensing dual viscous products which are separately retained within the package and merged at a dispensing nozzle. The dispensing package comprises a container having a compressible portion and a hanger and pouch assembly of plastic material suspended in the container. The hanger has an upper portion with a pair of openings. A flexible film pouch having an opening is bonded in each opening in the hanger and has portions bonded to the hanger. The hanger has lower portions comprising of spaced flexible walls associated with each pouch. The head assembly includes a one-way valve associated with each opening in the hanger and a portion which maintains the viscous products from each of the pouches separate until they pass from a nozzle on the head to the exterior when the compressible portion of the container is squeezed. An atmospheric valve is provided for equalizing the pressure after the compressible portion of the container has been released and the hanger and pouch assembly returns to its original position.

DESCRIPTION OF THE DRAWINGS

FIG. 12 is a fragmentary sectional view of a further modified form of the invention.

FIG. 13 is a fragmentary sectional view taken along the line 13—13 in FIG. 12.

DESCRIPTION

Figure 1:
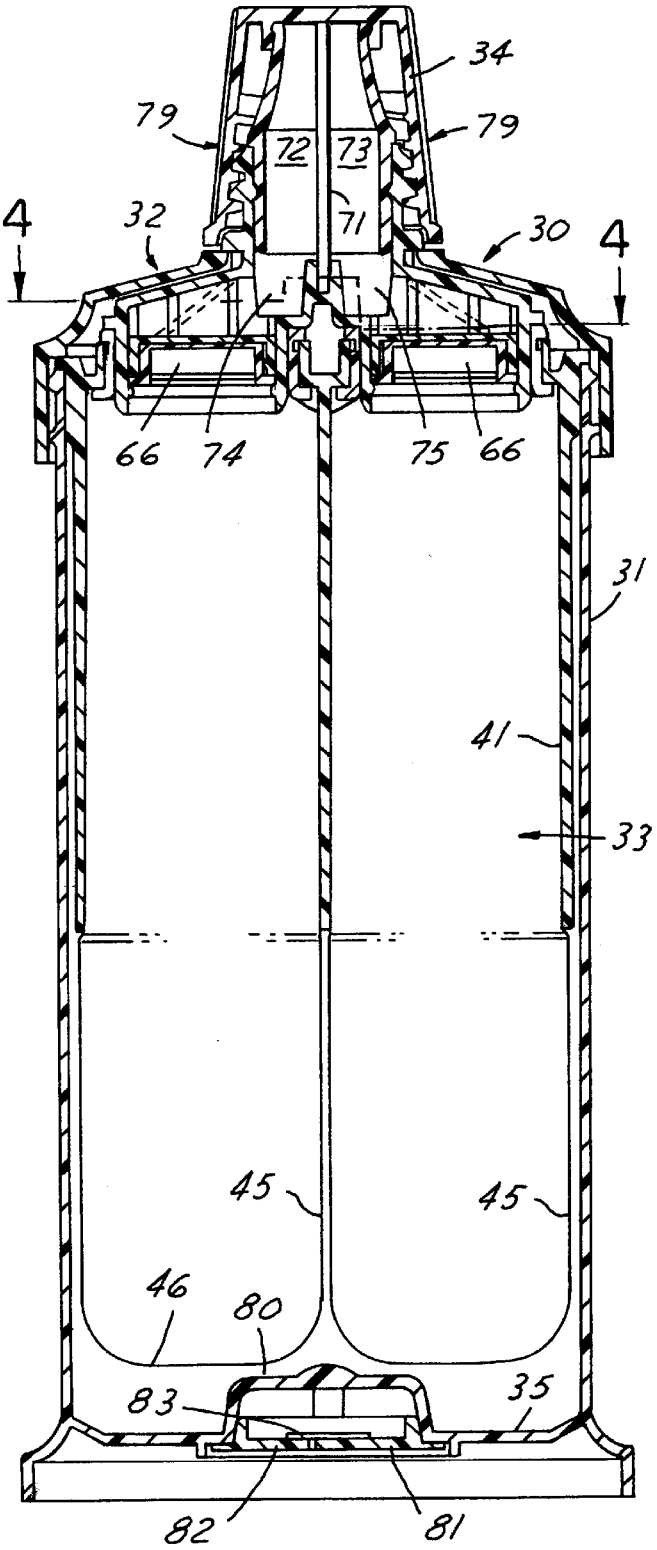
FIG. 1 is a sectional front elevational view of a dispenser package embodying the invention.

Referring to FIGS. 1–9, a squeeze dispensing package 30 embodying the invention comprises a container 31, a head assembly 32, a hanger and pouch assembly 33, and a cap 34. The head assembly 32 is removable from the container 31 so that the hanger and pouch assembly 33 can be replaced.

Figure 5:
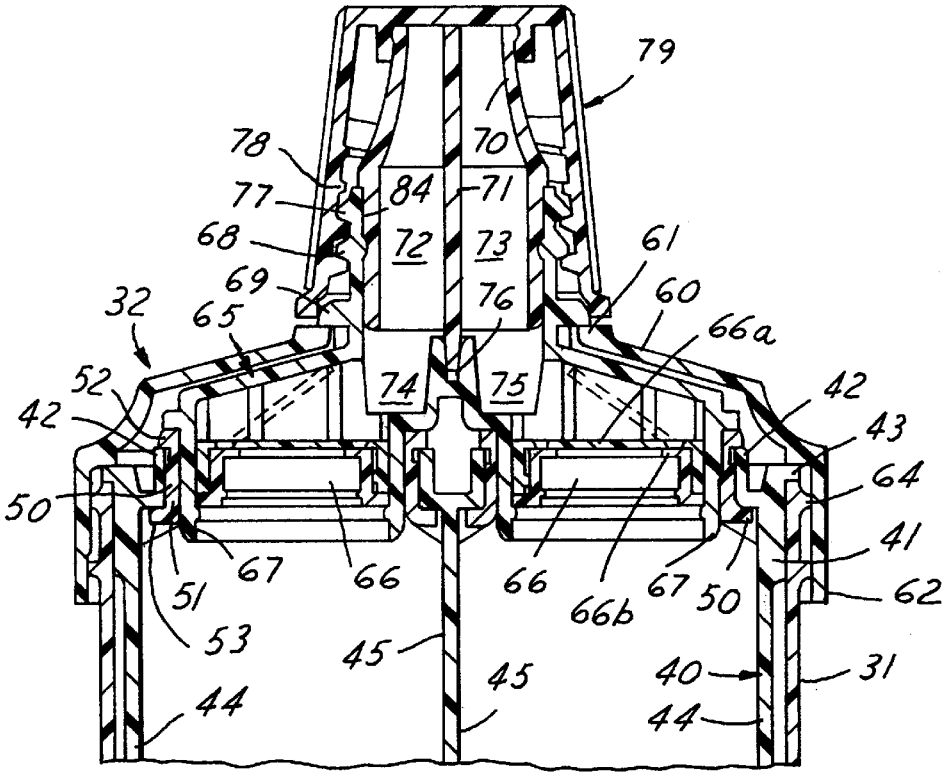
FIG. 5 is a fragmentary sectional view of a portion of FIG. 1 on an enlarged scale.
Figure 8:
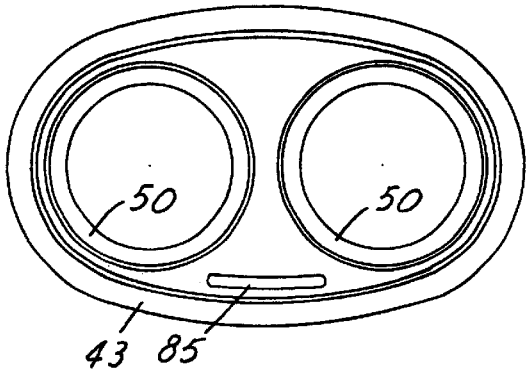
FIG. 8 is a top plan view of the hanger and pouch assembly.
Figure 9:
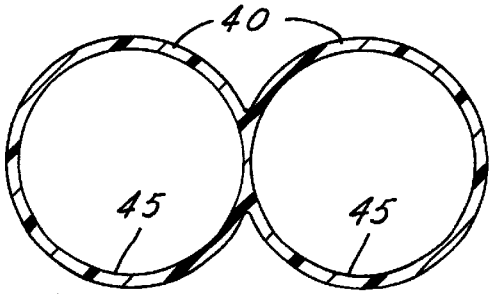
FIG. 9 is a sectional view taken along the line 9—9 in FIG. 6.
Figure 6:
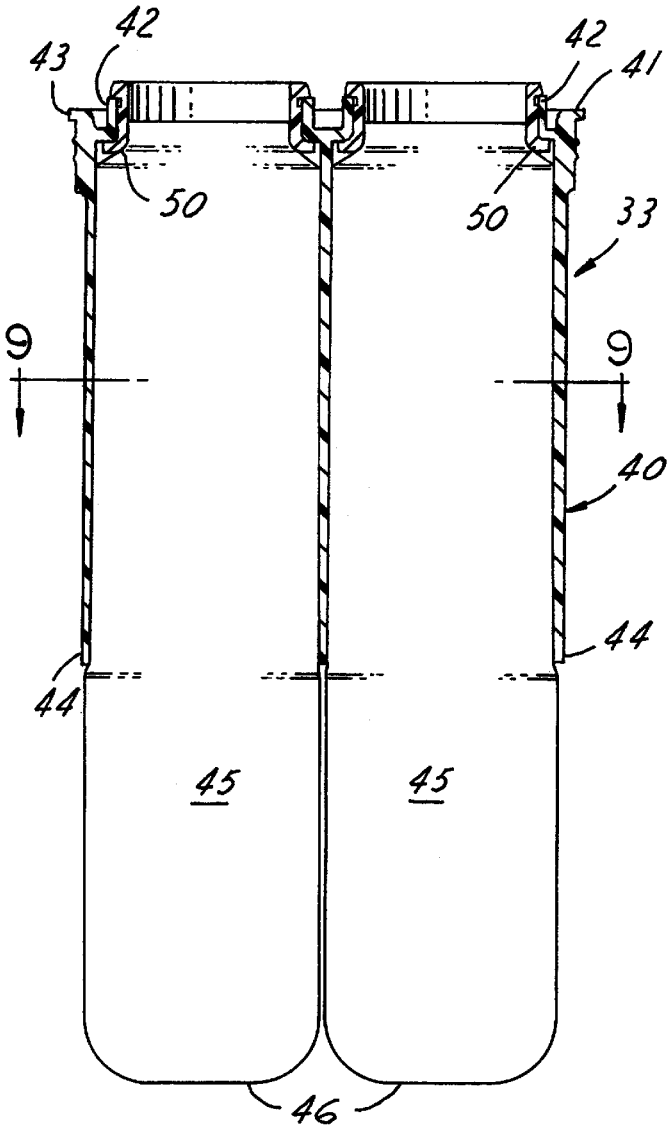
FIG. 6 is a part sectional elevational view of the hanger and pouch assembly.
Figure 7:
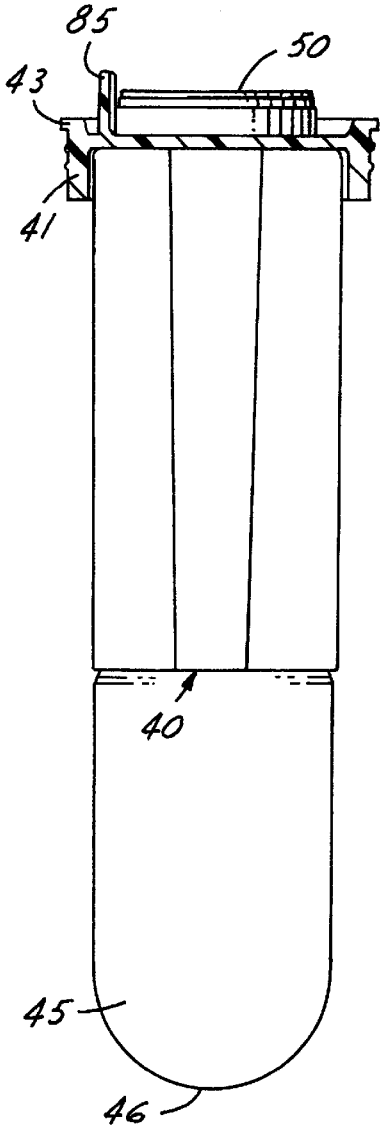
FIG. 7 is a side elevational view of the hanger and pouch assembly.

The hanger and pouch assembly 33 comprises a hanger 40. The hanger 40 includes a relatively rigid upper portion 41 including a pair of cylindrical portions 42 and a radial oval flange 43 that engages the upper end of the container 31 (FIG. 5). A pair of cylinders 44 extend axially downwardly from the cylinder portions 42. A pair of pouches 45 made of relatively flexible substantially imperforate lower portion 46 extend axially from the cylindrical portions 44.

A pouch 45 is provided for each of the cylindrical portions 42 of the hanger and pouch assembly 33 and comprises flexible film which is suspended and extends substantially beyond the lower portion 44 of the hanger (FIG. 5). The bottom 46 of each pouch is closed and the upper portion of each pouch is bonded to the inner surface of the flexible lower portions 44 of the hanger 40 at circumferentially spaced and vertically spaced areas so that the upper portion of each pouch 45 will be moved by the flexing of the lower portion 44 of the hanger. Preferably, each pouch 45 is bonded to the flexible portion 44 by heat sealing at vertically spaced areas.

Figure 2:
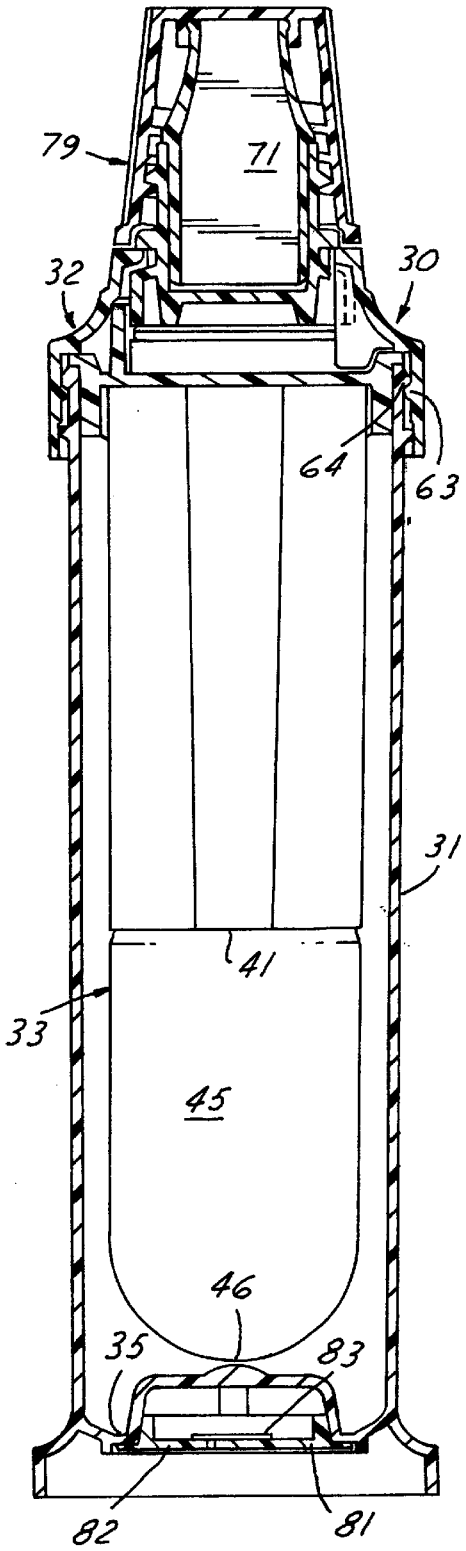
FIG. 2 is a sectional side elevational view of the dispenser package shown in FIG. 1.
Figure 3:
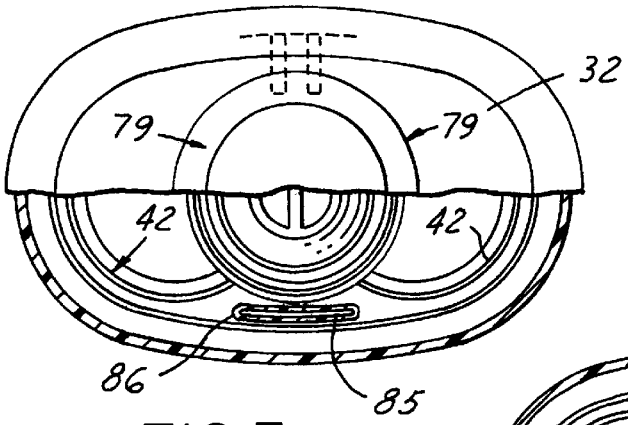
FIG. 3 is a top plan view, parts being broken away.
Figure 4:
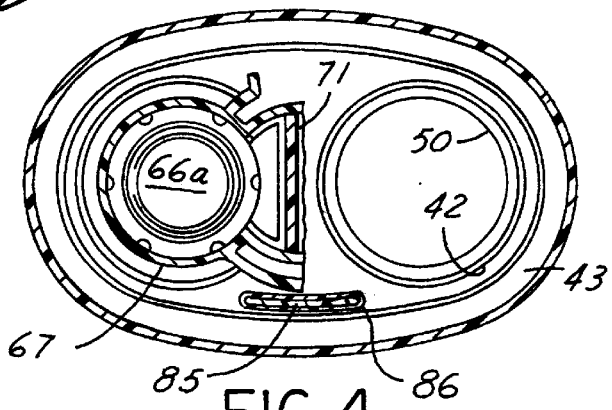
FIG. 4 is a sectional view taken along the line 4—4 in FIG. 1.

The pouch 45 may be sealed to its cylindrical opening 42 of hanger 40 directly or indirectly. As shown in FIGS. 1, 2 and 5, the open upper end of the pouch 45 is sealed by heat bonding to a plastic ferrule 50 which includes a central cylindrical body portion 51, an upper flange 52 and a wider lower flange 53. The upper end of the pouch 45 is sealed to the lower part of the cylindrical body portion 51.

Referring to FIG. 5, the head assembly 32 includes a plastic collar 60 that includes a central opening 61 and a peripheral skirt 62 having internal ribs 63 (FIG. 2) for engagement with external ribs 64 on the body 31. The head assembly 32 further includes a manifold 65 made of plastic and supporting one-way valves 66 in integral cylinders 67 which frictionally engage the ferrules 50. The manifold 66 includes an integral upwardly axially extending portion 68 that extends through the opening 61 in collar 60 and has a flange 69 engaging the periphery of the opening 61 to retain the manifold 65 on the collar 60.

A fitment 70 is frictionally provided in the opening 84 of the manifold 65 to form a nozzle that includes an integral intermediate wall 71 providing two chambers 72, 73 that communicate with openings 74, 75 in the manifold 65 to the respective interiors of the pouches 45. It can be seen that the intermediate wall 71 engages a recess 76 in the valve supporting member so that the components of the two pouches do not mix until they reach of the exterior of the nozzle of the fitment 70. The manifold 65 further includes external threads 77 that are engaged with internal threads 78 of the cap 79.

The hanger 40 includes an integral axial projection 85 which extends into a complementary recess 86 in the manifold 65 in order that upon removal and replacement of the hanger and pouch assembly 33, the hanger and pouch assembly will always be oriented circumferentially with respect to the manifold 65 such that the products that flow into chambers 72, 73, respectively, are the same.

The body 31 and the hanger 40 are made of a plastic material such that the side walls of the body 31 and the side walls of the hanger 40 are easily squeezable and yet are resilient enough and have sufficient elastic memory to return to normal when the squeeze is released.

The head assembly 32, one-way valve 66 and cap 34 are preferably made of plastic such as polypropylene. The body 31 and the atmospheric or equalizer valve 33 are preferably made of plastic such as linear low density polyethylene. The ferrules 50 are also preferably molded of plastic such as linear low density polyethylene.

As indicated, the cross section of body 31 is preferably oval to facilitate grasping and squeezing the body 31. The body 31 is sufficiently thin that it will flex under the squeezing pressure of a user. The flexible portions of the hanger 40 have a configuration such that a space exists between the outer surface of the flexible portion 44 and the inner surface of the wall of the body portion 35 of the container. Thus, the flexible portions of the hanger 40 will flex independently of the body 31.

The pouch 45 is made of a single layer or multilayer plastic film which will provide the desired protection for the product to be dispensed.

The design permits easy filling and assembly of the components. For example, the hanger and pouch assembly may be inserted into the body and filled with product through the ferrule 50. Air displaced during the filling process would be vented through the gate spider 80. The head assembly 32 is then snapped onto the top of the body 31, with the manifold entering the ferrule 50, sealing the contents of the hanger and pouch assembly 33. The atmospheric valve 81 is bonded in place in the bottom wall. Alternatively, the hanger and pouch assembly 33 may be filled before insertion into the body 31. Labeling and protective wrapping operations would follow.

To dispense viscous product, the closure 34 must be removed. Then the front and back panels of the body 31 may be pressed inwardly. This action causes the film flap valve 83 of the atmospheric valve 81 to seat firmly against the ports. Continuous pressure against the panels will force the products through the valves 66 and outwardly through the nozzle. When external pressure has been released the product will start to return to the inside of the pouches 45. This causes the valves 66 to close on the valve seats, stopping the return flow. Reduced internal pressure then causes the atmospheric valve 81 to lift away from the ports, admitting air into the space between the body 31 and the pouches 45. This causes the bottom of the pouches 45 to rise. Repeated dispensing of product continues to cause the bottom of the pouches 45 to rise until the product has been exhausted. At this point, the pouches 45 will have been inverted entirely within the hanger 40.

Thus, when the container 35 is squeezed, the hanger and pouch are also squeezed and the contents are dispensed. When the squeeze forces are removed, the container walls return to their original configuration. The reduced pressure between the pouches 45 and walls of body 31 provides a force tending to return the pouches 45 to their original configuration, assisted in part by the elastic memory of the hanger portions. At the same time, the reduced pressure in the contents of the pouches 45 closes the valves 66 but this is not instantaneous.

The dispenser may be refilled by:

1. Removing the head assembly 32 from the body 31.
2. Lifting the empty hanger and pouch assembly 33 from the body 31.

3. Lowering a filled hanger and pouch assembly 33 into the body 31.

4. Removing any seal from top of the hanger and pouch assembly 33.

5. Firmly snapping the head assembly 32 onto the top of the body 31.

Figure 10:
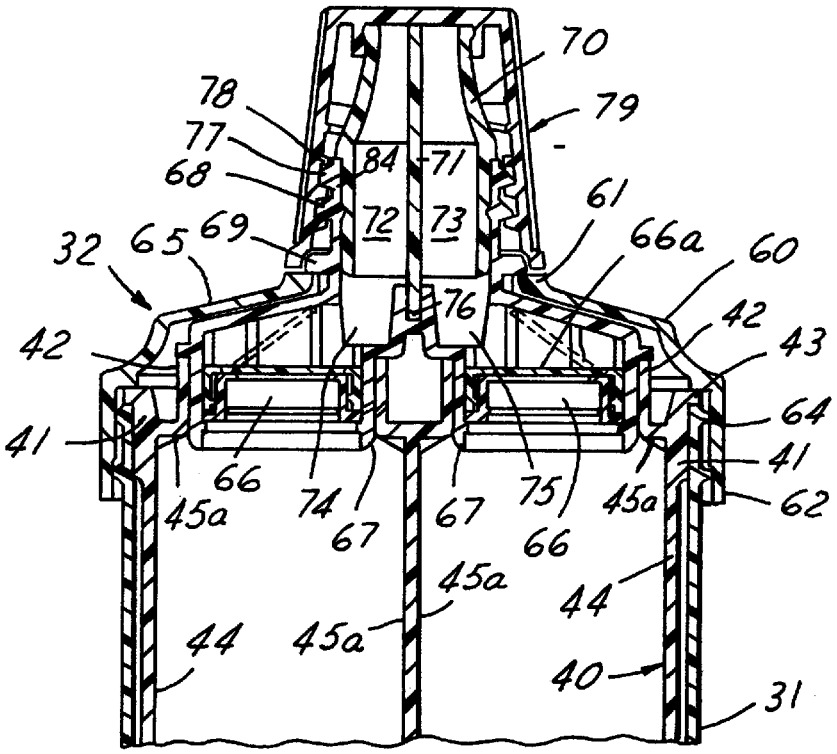
FIG. 10 is a fragmentary sectional view of a modified form of the invention.

In the form of invention shown in FIG. 10, the pouches 45*a* are bonded directly to the upper portion of the cylindrical openings 42 in the hanger 40 and the ferrules 50 are omitted. In all other respects the construction is like that shown in FIGS. 1–9.

Figure 11:
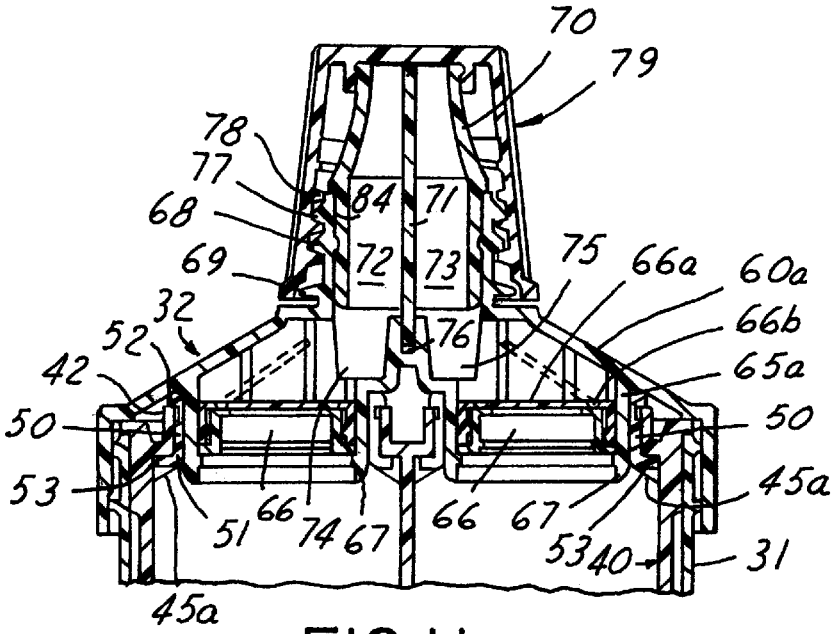
FIG. 11 is a fragmentary sectional view of another modified form of the invention.
Figure 14:
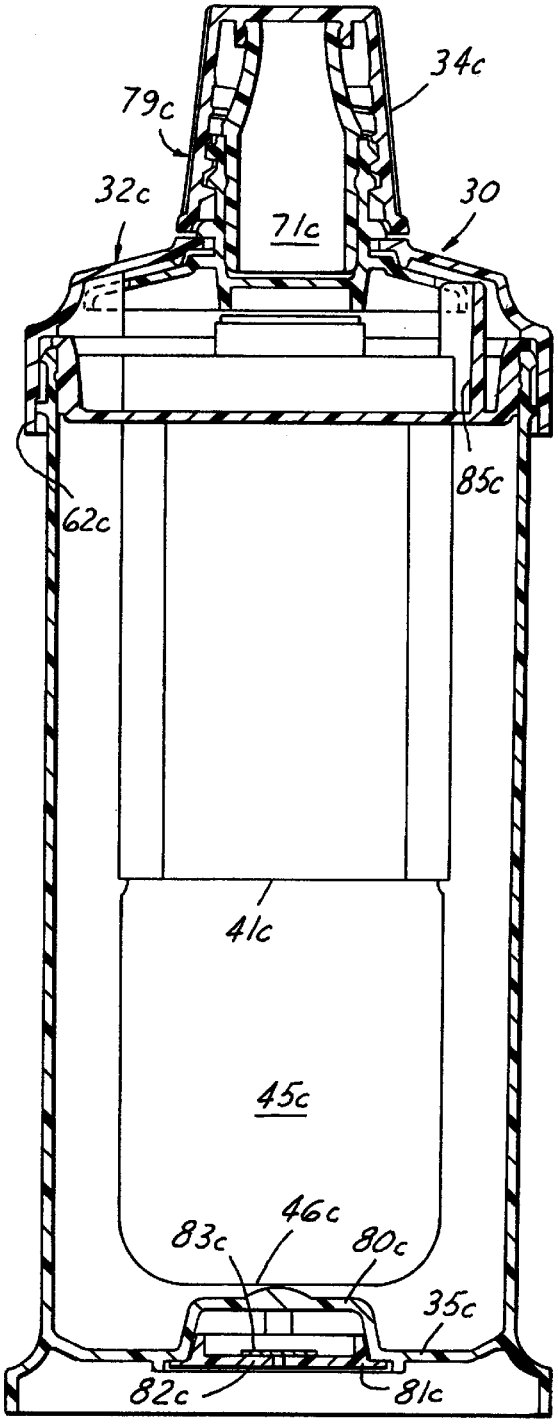
FIG. 14 is a vertical sectional view of a still further modified form of the invention.
Figure 15:
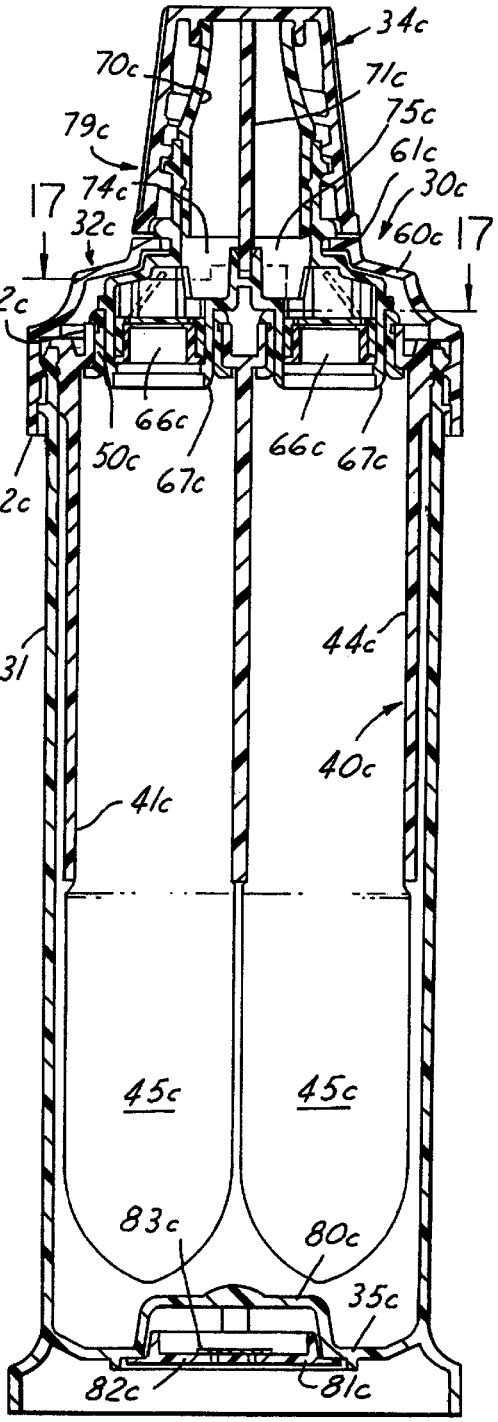
FIG. 15 is a sectional side elevational view of the dispenser package shown in FIG. 14.
Figure 16:
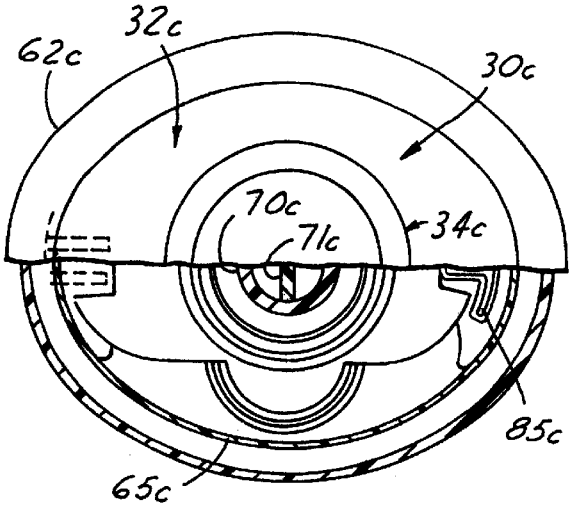
FIG. 16 is a fragmentary part sectional view of the dispenser package shown in FIG. 15 parts being broken away.
Figure 17:
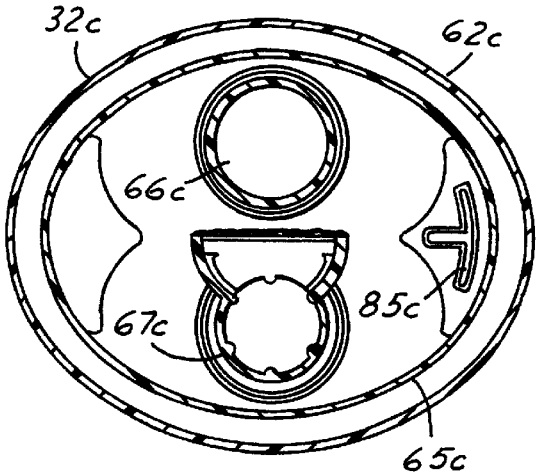
FIG. 17 is a sectional view taken along the line 17—17 in FIG. 15.
Figure 20:
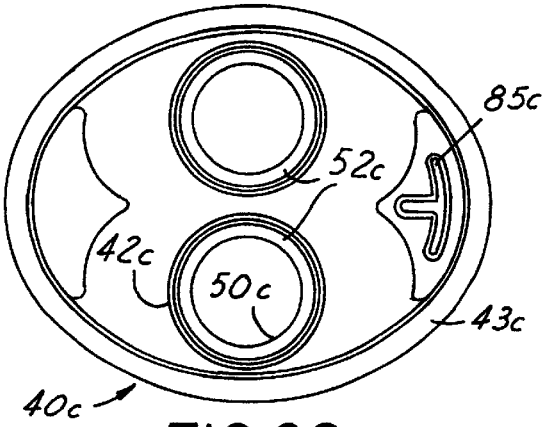
FIG. 20 is a top plan view of the hanger and pouch assembly shown in FIG. 18.
Figure 21:
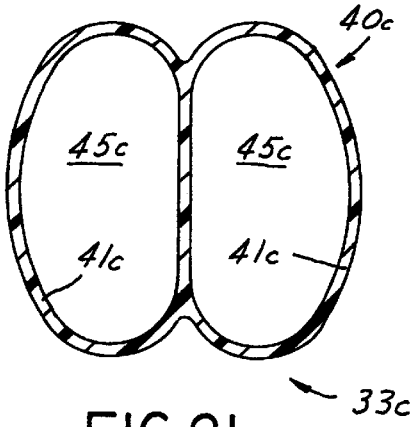
FIG. 21 is a sectional view taken along the line 21—21 in FIG. 19.
Figure 18:
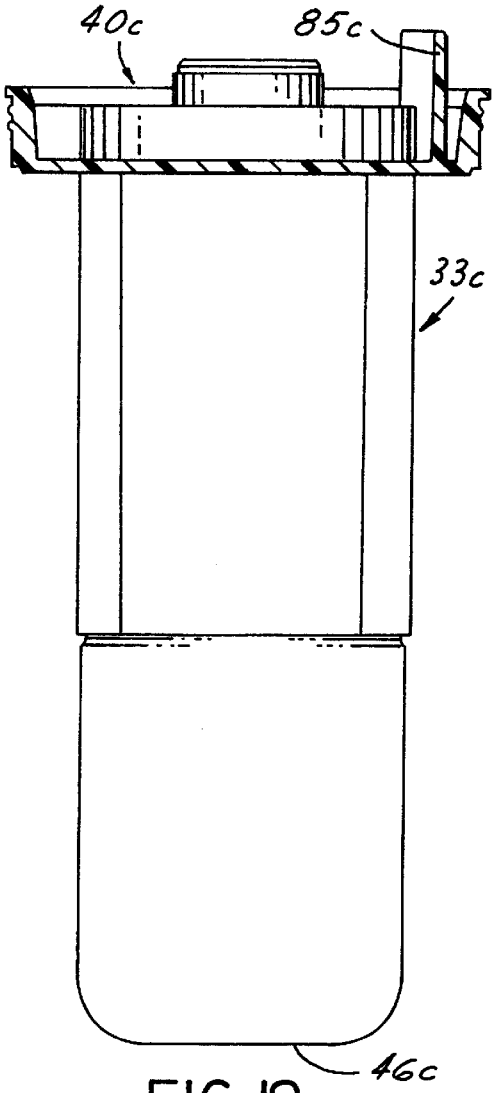
FIG. 18 is a part sectional front elevational view of the hanger and pouch assembly shown in FIG. 15.
Figure 19:
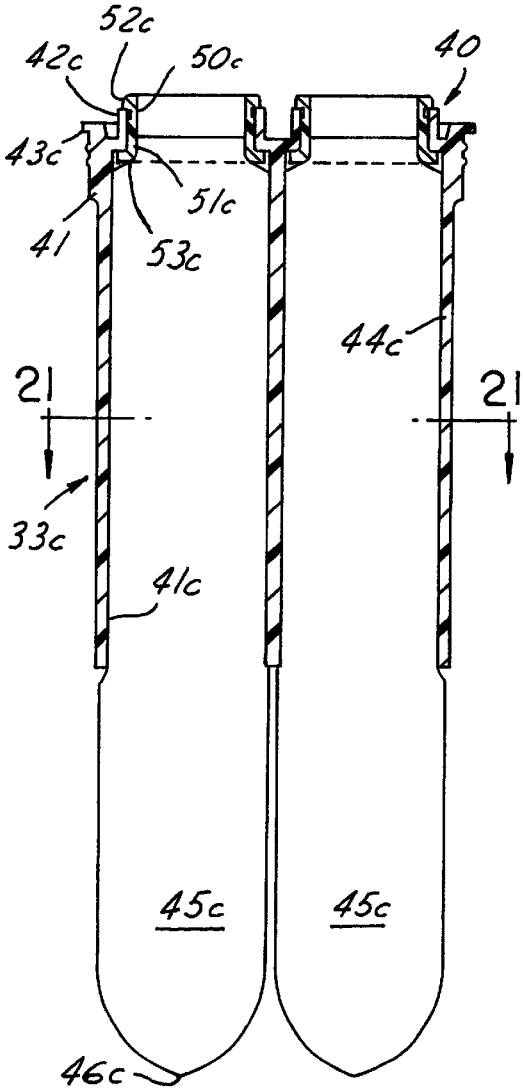
FIG. 19 is a part sectional side elevational view of the hanger and pouch assembly shown in FIG. 18.

In the form shown in FIG. 11, the collar 60*a* and the manifold 65*a* are made integral in one piece. In all other respects the construction is like that shown in FIGS. 1–9.

In the form shown in FIGS. 12 and 13, the individual one-way valves 66 are replaced by a single dual valve 90 provided on the manifold portion 68*a* and comprising a body having spaced openings and individual valve elements 91 connected by hinges 92 to the body portion.

In the forms of the invention shown in FIGS. 14–21, the construction is similar to that of the form shown in FIGS. 1–9 except that the pouches are provided side-by-side along the short axis of the oval cross section of the container rather than the long axis, corresponding parts being marked with the suffix "C".

What is claimed is:

1. A dispensing package for dispensing dual viscous products which are separately retained within the package and are merged after passing through a dispensing nozzle comprising a body having a compressible portion having an open end, a hanger and pouch assembly comprising a hanger suspended in the open end of said body and supporting at least two pouches of flexible material, each having an open end and a closed end, said hanger having flexible walls extending along a portion of said pouches, a head assembly comprising a collar and a manifold, said collar being removably positioned on the open end of said body, said manifold being interposed between said collar and said hanger and pouch assembly, said manifold including means defining first and second chambers communicating with each pouch and means defining a nozzle with second chambers communicating with said first chambers such that the products will not merge until after passage from said nozzle, a one-way valve associated with said chambers such that the product will flow from each pouch when the body is squeezed, and an equalizing valve mounted on said package to permit air to flow between the body and pouches and equalize the pressure when the squeeze pressure is released.

2. The squeeze dispenser package set forth in claim 1 wherein each said pouch is bonded to the interior surface of the flexible portions of said hanger.

3. The squeeze dispenser package set forth in claim 2 wherein said portions of each said pouch bonded to said hanger comprise axially and transversely spaced portions.

4. The squeeze dispenser package set forth in claim 2 wherein said portions of each said pouch extend transversely.

5. The squeeze dispenser package set forth in claim 1 wherein said pouch is bonded to the exterior surface of the flexible portions of said hanger.

6. The dispenser package set forth in claim 1 wherein said hanger and pouch assembly includes a ferrule associated with each pouch, each said pouch being sealed at its upper end to its respective ferrule.

7. The dispenser package set forth in claim 1 wherein each said pouch is sealed at its upper end to said hanger directly.

8. The dispenser package set forth in claim 1 wherein said manifold and said nozzle comprise separate members.

9. The dispenser package set forth in claim 4 wherein said nozzle has a central radial wall and interengaging means between said wall and said manifold defining said second chambers.

10. The dispenser package set forth in claim 1 wherein said manifold and said collar are integral.

11. The dispenser package set forth in claim 10 wherein said manifold and said nozzle comprise separate members.

12. The dispenser package set forth in claim 11 wherein said nozzle has a central radial wall and interengaging means between said wall and said manifold defining said second chambers.

13. The dispenser package set forth in claim 1 wherein said one-way valve comprises separate valves.

14. The dispenser package set forth in claim 1 wherein said valve comprises a single valve including separate valve elements.

15. The dispenser package set forth in claim 10 wherein said manifold and said nozzle comprise separate members.

16. The dispenser package set forth in claim 15 wherein said nozzle has a central radial wall and interengaging means between said wall and said single valve defining said second chamber.

17. The dispenser package set forth in anyone of claims 1–16 wherein each said hanger and pouch assembly is removable.

18. The dispenser package set forth in any one of claims 1–7 wherein said hanger and said head assembly include interengaging means for insuring the proper orientation of the first chambers and second chambers when the hanger and pouch assembly is replaced.

19. For use in a squeeze pump package comprising a plastic container having opposed compressible portions, a hanger and pouch assembly, said hanger and pouch assembly comprising a hanger made of plastic material, said hanger including means for suspending said hanger in a container, said hanger comprising a relatively rigid upper portion having at least two openings, said hanger having a lower portion comprising spaced flexible walls, at least two plastic film pouches having an opening bonded adjacent each opening to the opening in the hanger and having portions thereof bonded to said flexible portions of said hanger, each said film pouch comprising a sealed flexible lower portion extending beyond the lower portion of said hanger.

20. The hanger and pouch assembly set forth in claim 19 wherein each said pouch has portions bonded to the interior surface of the flexible portions of said hanger.

21. The hanger and pouch assembly set forth in claim 20 wherein said portions of each said pouch bonded to said hanger comprise axially and transversely spaced portions.

22. The hanger and pouch assembly set forth in claim 20 wherein said portions of said pouches extend transversely.

23. The hanger and pouch assembly set forth in claim 19 wherein each said pouch is bonded to the exterior surface of the flexible portions of said hanger.

24. The hanger and pouch assembly set forth in claim 19 including a ferrule insertable into each said opening in said hanger, each said pouch being bonded to a respective ferrule.

25. The hanger and pouch assembly set forth in claim 24 wherein each said pouch is heat sealed to the exterior of said ferrule.

26. The hanger and pouch assembly set forth in claim 24 wherein said pouch is heat sealed to the interior of said ferrule.

27. The hanger and pouch assembly set forth in claim 19 wherein said means for suspending said hanger and pouch assembly within a container comprises a removable head assembly adapted to be mounted on a container to hold said hanger and pouch assembly in position in a container.

28. The hanger and pouch assembly set forth in claim 27 including interengaging means between said hanger and pouch assembly for orienting said hanger and pouch assembly circumferentially.

29. The hanger and pouch assembly set forth in claim 19 wherein said hanger includes a flange engaging the upper end of a body portion of a container.

30. The hanger and pouch assembly set forth in claim 29 wherein said relatively rigid upper portion includes a portion adapted to extend into the upper end of a container and have an interference fit with a container.

31. The hanger and pouch assembly set forth in claim 19 wherein said hanger has a shoulder with a venting opening therein.

* * * * *

UNITED STATES PATENT AND TRADEMARK OFFICE

CERTIFICATE OF CORRECTION

PATENT NO. : 6,308,862 B1
DATED : October 30, 2001
INVENTOR(S) : William E. Fillmore It is certified that error appears in the above-identified patent and that said Letters Patent is hereby corrected as shown below:

Column 4,
Line 18, "portion 35" should read -- portion 31 --.
Line 54, "container 35" should read -- container 31 --.

Signed and Sealed this

Seventh Day of May, 2002

*Attest:*

*Attesting Officer*

JAMES E. ROGAN
*Director of the United States Patent and Trademark Office*